US005549243A

United States Patent [19]

Dorier et al.

[11] Patent Number: 5,549,243

[45] Date of Patent: Aug. 27, 1996

[54] BLANK FOR EASILY OPENED BOX AND THE BOX FORMED FROM SUCH BLANK

[75] Inventors: Regis G. Dorier, Fragnes; Daniel Staszak, Saint-Remy, both of France

[73] Assignee: Eastman Kodak Company, Rochester, N.Y.

[21] Appl. No.: 382,311

[22] Filed: Feb. 1, 1995

[30] Foreign Application Priority Data

Feb. 7, 1994 [FR] France ..... 94 01547

[51] Int. Cl.[6] ..... B65D 17/28

[52] U.S. Cl. ..... 229/244; 229/237

[58] Field of Search ..... 229/222, 237, 229/244, 229, 234

[56] References Cited

U.S. PATENT DOCUMENTS

| | | | |
|---|---|---|---|
| 2,854,184 | 9/1958 | Heine | 229/244 |
| 2,970,743 | 2/1961 | Joseph et al. . | |
| 3,522,907 | 8/1970 | Utterback | 229/237 X |
| 3,580,482 | 5/1971 | Witte | 229/237 X |
| 3,606,135 | 9/1971 | Rosenburg, Jr. | 229/244 |
| 3,829,006 | 8/1974 | Spiegel | 229/237 X |
| 3,865,322 | 2/1975 | Hennessey | 229/222 |
| 3,958,748 | 5/1976 | Smith et al. | 229/234 |
| 4,676,430 | 6/1987 | Wischusen, III et al. | 229/237 X |

*Primary Examiner*—Allan N. Shoap
*Assistant Examiner*—Christopher J. McDonald
*Attorney, Agent, or Firm*—Clyde E. Bailey, Sr.

[57] ABSTRACT

A box blank can be used for American boxes (10), the main flaps (20, 20', 22, 22') of which have dimensions practically equal to the opening of the box and which are glued to each other to close this box. The outer top flap (20) has a perforation (30) located in the vicinity of the fold and the inner top flap (22) has a first cutout (40) adapted so as not to interfere with the pressing down of the middle part (36) of the perforation (30) during the opening of the box, and a second cutouts (42, 44) adapted so as not to interfere with the tearing off of the outer top flap 20 when the box is opened completely.

18 Claims, 4 Drawing Sheets

BLANK FOR EASILY OPENED BOX AND THE BOX FORMED FROM SUCH BLANK

FIELD OF THE INVENTION

The invention relates to packaging. More particularly, the invention concerns opening of cardboard boxes used for packing several bottles or other objects in a single box.

BACKGROUND OF THE INVENTION

Parallelepipedal cardboard boxes for packaging are known which include panels than can be folded over two by two and that are integral with the vertical faces of the box so as to form on the one hand the bottom of the box and on the other hand the top of this box. These boxes are commonly known in the art as American boxes. The invention is applicable to certain types of American box. The boxes that can be used with the invention generally have two lateral flaps which, when they are folded at an angle of 90°, are disposed opposite each other at the same level, and two flaps, one on the outside and the other on the inside, which, when they are folded at an angle of 90°, cover practically the whole of the opening of the box and are stuck to each other to form and close the box.

In order to open such conventional boxes, it is necessary to insert an instrument, for example the blade of a knife, under the flap or flaps, or to take hold of the latter by their lateral edge by hand or to put the box out of shape in order to be able to lift the flaps, all of which are common, but relatively inconvenient, operations. It has already been proposed to equip such cardboard boxes with tongues or tear-off strips made of plastic, such as polyethylene for example, enabling the cardboard to be torn and the box to be thus opened. However, the use of such tear-off strips embedded in the cardboard increases the cost of the box and prevents recycling because of this inclusion of a foreign material.

The invention therefore proposes to provide a box with an efficient means of opening, at a lower cost than that of boxes equipped with tear-off strips but which is easy to open and does not require the use of additional tools.

SUMMARY OF THE INVENTION

The invention relates to a blank for a cardboard box, of length L, width l and height h, having on the one hand a main part, the length of which is practically equal to 2(L+l) and the width of which is equal to the height h of the box, and which is provided with folding lines so as to enable the blank to be folded to form the box, the main part being equipped, at one of those of its ends which have a dimension equal to the height, with a tab designed to be glued to the other end of the main part so that this main part, after the gluing and folding of the blank along folding lines disposed transversely on this main part, defines the four vertical walls of the box, two lateral walls of width l and height h, and a front wall and rear wall of length L and height h. On the other hand the blank has two series of four flaps disposed on each side of the main part to form, respectively, the bottom and top of the box, each series of flaps comprising two lateral flaps with a general shape that is practically square and an outer and inner flap each having a surface covering practically the whole of the surface of the bottom or top of the box once the latter has been formed. A blank is characterised in that:

a) the outer top flap, joined to the top of the box, has a perforation in three parts, two practically symmetrical outer parts defining arcs of a circle having practically the same centre and disposed in the vicinity of the folding line between the outer top flap and the main part, and a middle part, the convex side of which faces in the opposite direction to the convex side of the two outer parts, the distance between the points on the outer parts of the perforation and the folding line increasing progressively with the distance from the middle part along this perforation; and b) the inner top flap, joined to the top of the box, has, on its outer edge, opposite the folding line between the inner top flap and the main part, a first shape adapted to the middle part of the perforation so as scarcely to interfere with the pressing down of the part of the outer top flap defined by the middle part of the perforation during the opening of the box, and a second shape adapted to the two outer parts of the perforation so as scarcely to interfere with the tearing off of the outer top flap during the opening of the box.

BRIEF DESCRIPTION OF THE DRAWINGS

Other characteristics and advantages of the invention will emerge from a reading of the following description, given with reference to the accompanying drawing in which.

DETAILED DESCRIPTION OF THE INVENTION

Figure 5:
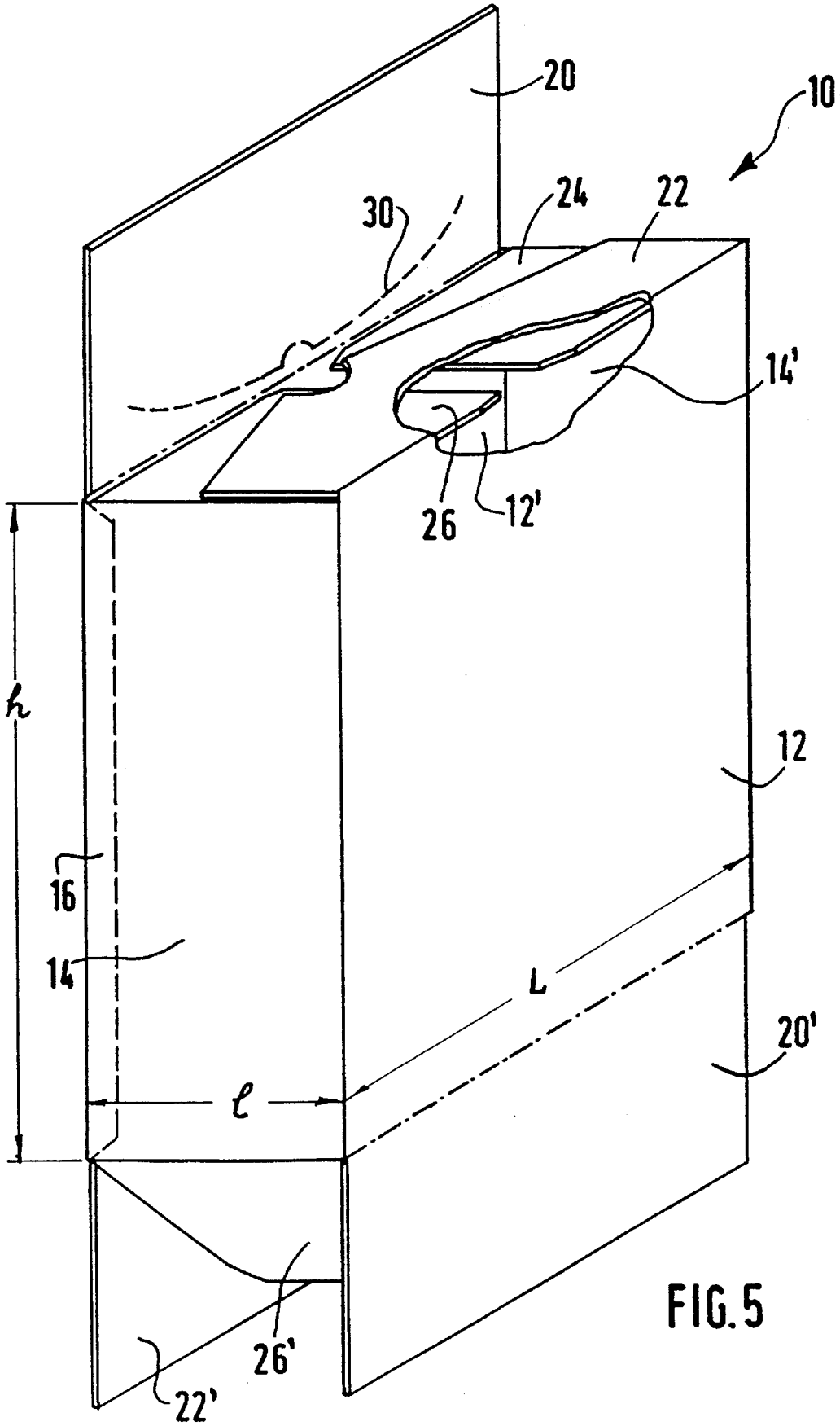
FIG. 5 shows diagrammatically in perspective an American box according to the invention.

In the different figures identical elements bear the same reference numeral. FIG. 5 shows diagrammatically an American box 10 well known in the art, which has been modified to incorporate the invention. This box is obtained from a blank (shown for example in FIGS. 1 or 2) which has been cut out and provided with folding lines (shown in dot-and-dash lines in the various figures), so as to allow easy folding along these folding lines.

Figure 1:
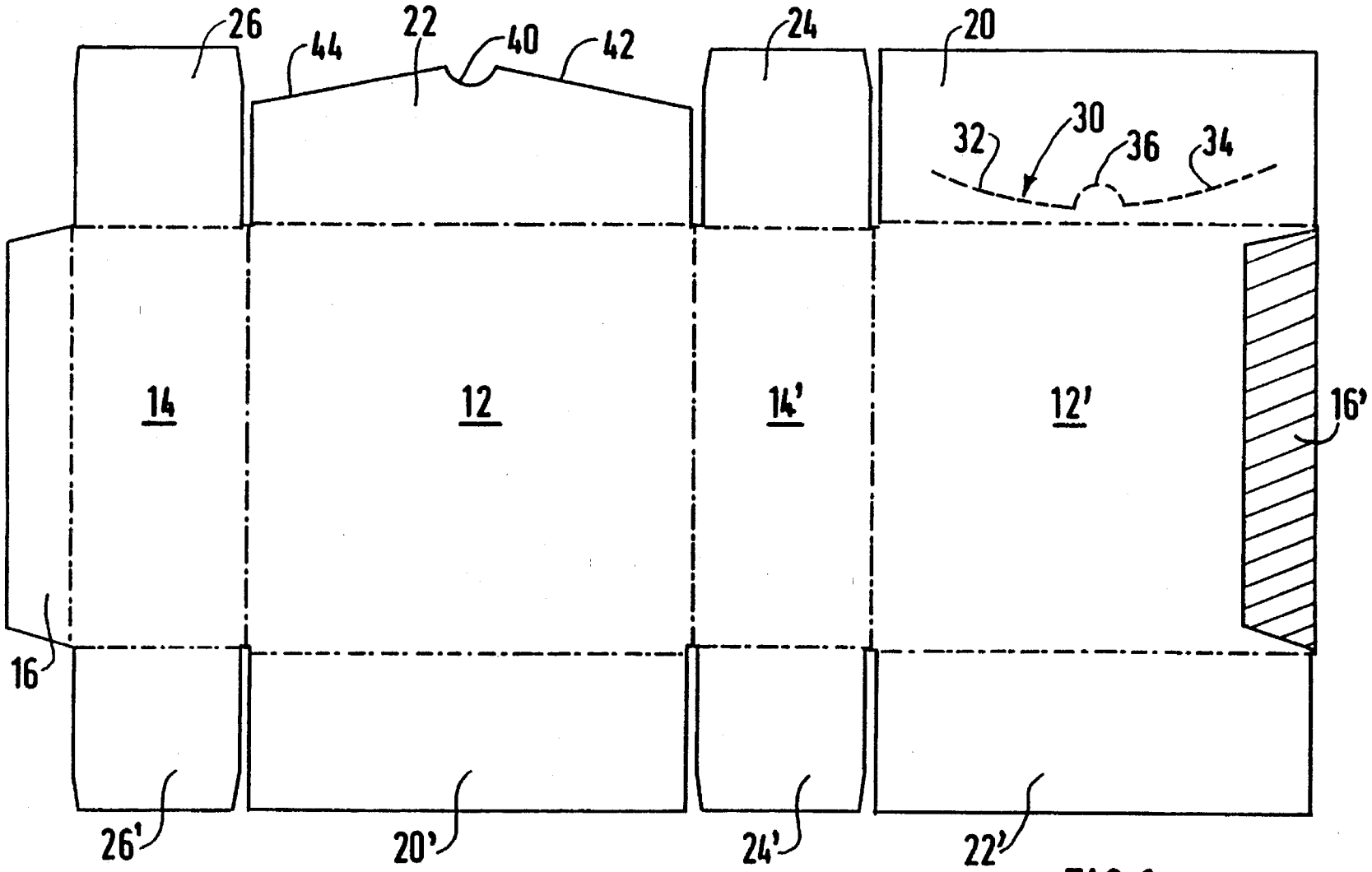
FIG. 1 shows a first embodiment of a blank according to the invention.
Figure 2:
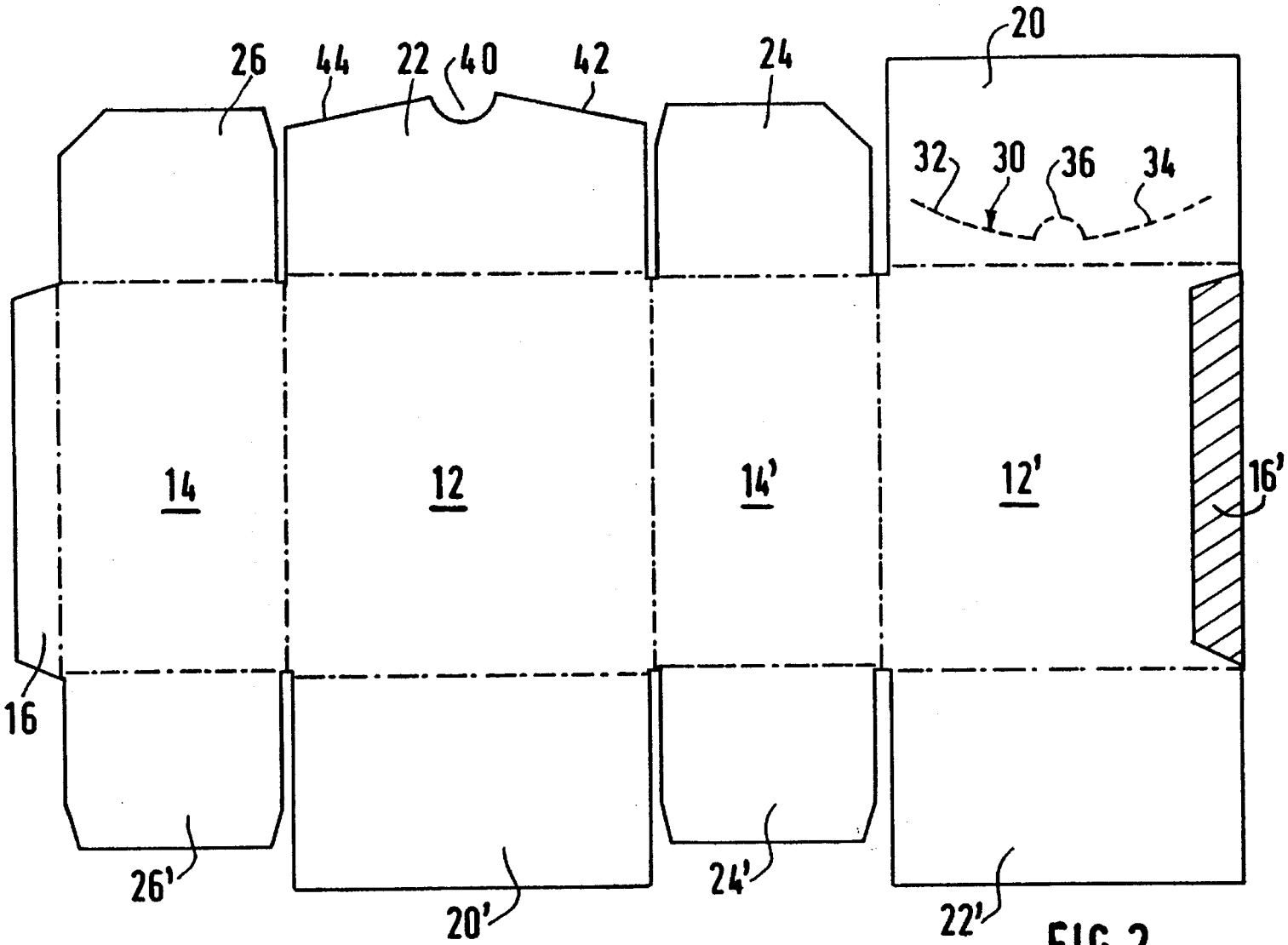
FIG. 2 shows another embodiment of a blank according to the invention, for a box with different dimensions.

As can be seen in FIG. 5, the box has a length L, a width l and a height h. The four vertical walls of the box, only two of which are clearly visible in FIG. 5, bear the reference numerals 12, 12', 14 and 14'.One of the vertical walls 14, defining one side of the box 10, is extended over the entire height of the box by a tab 16 intended to be glued to the inside of the adjacent vertical wall (when the box is formed) in order to form the body of the box 10. In FIGS. 1 and 2 the tab 16 is intended to be glued to the corresponding hatched part 16' of the wall 12'. The top of the box consists of four flaps, an outer top flap 20, an inner top flap 22, and two lateral top flaps 24 and 26. The invention applies to boxes, the outer and inner flaps of which cover practically the whole of the top of the box 10. Advantageously, the flaps are provided with chamfers making implementation easier. In FIG. 5, the inner top flap has been folded back to its normal position during the closure of the box according to the invention. In addition, certain parts of the box have been cut away to provide a better view of the lateral top flaps.

The bottom of the box 10 consists, in a way that is similar to the top of the box, of four flaps, an outer bottom flap 20', an inner bottom flap 22' and two lateral bottom flaps 24' and 26'. Advantageously, the top and bottom outer flaps are attached to different vertical walls, 12 and 12' respectively.

To form the box 10, the lateral bottom flaps 24' and 26' are folded down first of all, then the inner bottom flap 22' and finally the outer bottom flap 20' which is glued at its inner face to the outer face of the inner bottom flap. After the box has been filled, it is closed by folding down the lateral top flaps 24 and 26, then the inner top flap 22 and finally the outer top flap 20 which is glued at its inner face to the outer face of the inner top flap. The gluing operations can obviously be carried out simultaneously after the box has been filled.

According to the invention, and in order to ensure that the box is easy to open, the outer top flap 20 is provided with a perforation 30, of predetermined shape and located in the vicinity of the folding line between the outer top flap and the vertical wall 12' to which it is attached. This perforation consists of three parts, two outer parts 32, 34 on each side of a middle part 36.

As can be seen in FIGS. 1 to 4, the outer parts are practically symmetrical and have the shape of arcs of circles. Advantageously the centres of the arcs of circles are merged and are located on the mid-perpendicular of the folding line located between the outer top flap 20 and the vertical wall 12' to which it is attached. The arcs of circles are disposed as shown in FIGS. 1 and 2 in such a way that the distance between the points of the outer parts 32, 34 of the said perforation 30 and the folding line increase progressively along this perforation with the distance from the middle part 36 of this perforation 30.

Shaping the outer parts 32, 34 of the perforation 30 as arcs of circles, parts which get further away from the fold at the top of the box, makes it possible to reduce the amount of effort to be made when the box is opened and the outer top flap 20 is torn off. The middle part 36 of this perforation may assume various shapes as shown in FIGS. 1 to 4. This middle part is intended to be pushed down inside the box, for example by pressing with the thumb.

Advantageously, the size of this middle part after being pushed down allows two or three fingers to be inserted inside the opening produced by this pushing down and thus enables the outer top flap and the inner top flap to which it is glued to be pulled easily. In order for the perforation to be in the immediate vicinity of the fold of the box, the concave side of the middle part 36 of the perforation 30 faces the opposite way to the concave side of the curve defined by the outer parts 32, 34 of the perforation.

Figure 4:
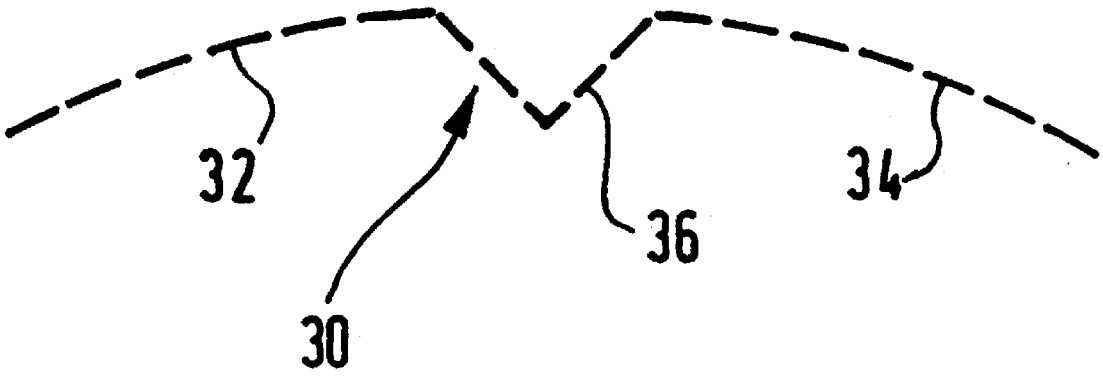
FIGS. 3 and 4 show diagrammatically other possible configurations for the perforation system according to the invention.
Figure 3:
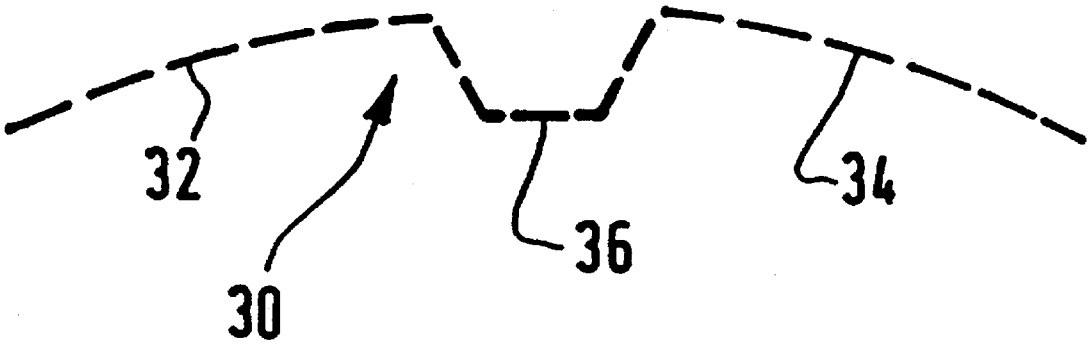

As can be seen in FIG. 3, the middle part may take the shape of a trapezium or, as shown in FIG. 4, it may have a triangular shape.

In a preferred embodiment shown in FIGS. 1 and 2, the middle part has practically the shape of a semi-circle, the convex side of which faces the opposite way to the convex side of the curve defined by the two outer parts.

In order to be able to open the box easily, it is also necessary to adapt the shape of the inner top flap 22. The outer edge of the inner top flap, opposite the folding line between the flap and the vertical wall 12 to which it is connected, must have a first cutout 40 adapted to the shape of the middle part 36 of the perforation 30 so as not to interfere with the pressing down of the part of the outer top flap during opening. In an advantageous embodiment, the cutout 40 has the shape of a portion of a circle with a larger diameter than the maximum dimension of the middle part 36 of the perforation and is practically centred on this middle part when the outer top flap is folded at 90° to the vertical wall of the box.

It is also necessary to remove certain parts of the inner top flap 22 because they would come up against the part of the outer top flap 20 located between the perforation 30 and the fold at the folding line when the box is closed. Thus the outer edge of the inner top flap 22 also has a second cutout 42, 44 in accordance with the outer parts 32, 34 so as scarcely to interfere with the tearing off of the outer top flap 20 when the box is opened.

In a preferred embodiment, this second cutout is a straight line joining the first cutout to the sides of the inner top flap disposed in the vicinity of the lateral vertical walls 14, 14' of the box so that the dimension of the inner top flap at the level of the sides is approximately equal to the distance separating the ends of the perforation 30 from the edge of the outer top flap opposite the folding line connecting the outer top flap to the corresponding vertical wall of the box.

In another embodiment, as shown in FIG. 2, in which the length L of the box is less than twice the width l of the box, the lateral flaps 24, 26 and 24', 26' must have slightly reduced dimensions in order not to overlap when they are folded down during the forming and closure of the box. It is obvious that when the length L of the box is slightly less than twice the width l of the box, the dimensions of only one of the lateral top and bottom flaps may be reduced in order to prevent them from overlapping when the box is formed and closed.

For such boxes, it is necessary to provide an extra cutout in the two lateral top flaps. This cutout is located in one of the corners of the two lateral flaps 24, 26, the one which is opposite the inner top flap 22 and the respective folding line connecting the lateral flap to the corresponding vertical lateral wall 14, 14' of the box. In this way, this extra cutout coincides, when the box is closed, with the position of the middle part 36 of the perforation 30. Thus no part of the box is in a position which corresponds with the middle part 36 of the perforation 30 and nothing prevents the corresponding part of the outer top flap from being pushed down.

In a preferred embodiment, the cardboard box is made from 2.4 BE corrugated cardboard (ref. LNE C.27) that is, a double-faced double sandwich of pieces of corrugated cardboard having small ribbings and microribbings separated by a smooth cardboard, the whole being covered on each side by smooth sheets of cardboard.

Advantageously, the perforation consists of an alternating successive series of cut and uncut sections. In a particularly advantageous embodiment, the length of the cut sections is equal to twice the length of the uncut sections. With the above-mentioned corrugated cardboard, the length of the uncut sections is 3 mm and the length of the cut sections is 6 mm.

To give the box the proper strength when closed and thus enable them to be stacked, it is advantageous for the ends of the perforation 30 to be located about 4 cm from the lateral edges of the outer top flap and for the distance between the perforation 30 and the folding line connecting the outer flap to the corresponding vertical wall of the box to be about 15 mm, at its nearest point.

Advantageously the diameter of the middle part of the perforation is about 6 cm and the radius of the arcs of circles defining the two outer parts of the perforation is less than 35 cm. In an advantageous embodiment, this radius is 27 cm. The diameter of the first cutout 40 is greater than the diameter of the middle part 30 of the perforation and in an advantageous embodiment is about 8 cm. In a particularly advantageous embodiment, in which the middle part practically has the shape of a semi-circle, it is advantageous for the perforated section at the level of the axis of symmetry of the perforation 30 to be appreciably larger than the other perforated sections. In a particular embodiment, the cut sections have a dimension of 6 mm and the cut section at the level of the axis of symmetry has a dimension of about 20 mm. This larger cut increases further the ease of opening of the box.

The boxes described above have an opening system which is easy to use. In addition, the opening system does not contain any foreign material preventing them from being recycled.

Parts List

L . . . length
l . . . width
h . . . height
10 . . . box
12,12' . . . front and rear vertical walls
14,14' . . . left and right side vertical walls
16 . . . tab on wall 14
16' . . . part of wall 12' to which 16 is glued
20 . . . outer top flap
20 ' . . . outer bottom flap
22 . . . inner top flap
22' . . . inner bottom flap
24,26. . . lateral top flaps
24',26' . . . lateral bottom flaps
30 . . . perforation in flaps 20
32,34 . . . arcuate outer parts of 30
36 . . . arcuate middle part of 30
40 . . . central cut out in flap 22
42,44 . . . corner cut outs in flap 22

We claim:

1. A blank for a cardboard box, of length L, width l and height h, having a main part, the length of which is substantially equal to 2(L+l) and the width of which is equal to the height h of the box, and which is provided with folding lines so as to enable the blank to be folded to form the box, the main part being equipped, at one end which has a dimension equal to the height, with a tab (16) designed to be glued to another end (16') of the main part so that this main part, after the gluing and folding of the blank along the folding lines disposed transversely on this main part, defines the four vertical walls of the box, two lateral walls (14, 14') of length L and height h, and a front wall (12) and rear wall (12') of length L and height h, and two series of four flaps disposed on each side of the main part to form, respectively, the bottom and top of the box, each series of flaps comprising two lateral flaps (24, 26, 24', 26') with a general shape that is substantially square and an outer and inner flap (20, 22, 20', 22') each having a surface covering substantially the whole of the surface of the bottom or top of the box, once the latter has been formed, characterised in that:

a) the outer top flap (20), joined to the top of the box, has a perforation (30) in three parts, two substantially symmetrical outer parts (32, 34) defining arcs of a circle having substantially the same centre and disposed in the vicinity of the folding line between the outer top flap and the main part, and a middle part (36), a convex side of which faces in an opposite direction to a convex side of the two outer parts, the distance between the points on the outer parts of the perforation and the folding line increasing progressively with the distance from the middle part along this perforation, b) the inner top flap (22), joined to the top of the box, has, on its outer edge, opposite the folding line between the inner top flap and the main part, a first shape (40) adapted to the middle part of the perforation so as to slightly interfere with the pressing down of the part of the outer top flap defined by the middle part of the perforation during the opening of the box, and a second shape (42, 44) adapted to the two outer parts of the perforation so as to slightly interfere with the tearing off of the outer top flap during the opening of the box.

2. A blank according to claim 1, for the production of a box, the length L of which is less than twice the width l of this box, in which at least one of the top lateral flaps and at least one of the bottom lateral flaps has a width which is less than the width of the box and characterised in that the corner of each of the two lateral top flaps opposite the inner top flap and the corresponding folding line connecting this flap to the corresponding lateral vertical wall of the box, is cut out in such a way as to free the area located opposite the middle part of the perforation when the box is closed in order not to interfere with the pressing down of the part of the outer top flap defined by the middle part of the perforation during the opening of the box.

3. A blank according to claim 1, in which the middle part of the perforation is practically a semi-circle.

4. A blank according to claim 1, in which the first shape is a semi-circular cutout.

5. A blank according to claim 1, in which the second shape consists of two linear sloping parts connecting the first shape to the sides of the inner top flap which are adjacent to the lateral walls of the box so that the dimension of the inner top flap at the level of these sides is approximately equal to the distance separating the ends of the perforation of the side of the outer top flap opposite the folding line connecting the said outer top flap to the corresponding vertical wall of the box.

6. A blank according to claim 1, for producing a corrugated cardboard box of the 2.4 BE type, characterised in that the perforation comprises a succession of cut sections alternating with uncut sections, the cut sections having a length which is double that of the uncut sections.

7. A blank according to claim 6, in which the arcs of circles defining the outer parts of the perforation have a radius of less than 35 cm.

8. A blank according to claim 6, in which the sections of the outer parts of the perforation located in the vicinity of the middle part are separated by a distance of about 6 cm.

9. A blank according to claim 6, in which the perforation ends about 4 cm from the lateral walls of the box.

10. A cardboard box formed from a blank having length L, width l and height h, and having a main part, the length of which is substantially equal to 2(L+l) and the width of which is equal to the height h of the box, and which is provided with folding lines so as to enable the blank to be folded to form the box, the main part being equipped, at one end which has a dimension equal to the height, with a tab (16) designed to be glued to another end (16') of the main part so that this main part, after the gluing and folding of the blank along the folding lines disposed transversely on this main part, defines the four vertical walls of the box, two lateral walls (14, 14') of length L and height h, and a front wall (12) and rear wall (12') of length L and height h, and two series of four flaps disposed on each side of the main part to form, respectively, the bottom and top of the box, each series of flaps comprising two lateral flaps (24, 26, 24', 26') with a general shape that is substantially square and an outer and inner flap (20, 22, 20', 22') each having a surface covering substantially the whole of the surface of the bottom or top of the box, once the latter has been formed, characterized in that:

a) the outer top flap (20), joined to the top of the box, has a perforation (30) in three parts, two substantially symmetrical outer parts (32, 34) defining arcs of a circle having substantially the same centre and disposed in the vicinity of the folding line between the outer top flap and the main part, and a middle part (36), a convex side of which faces in an opposite direction to a convex side of the two outer parts, the distance between the points on the outer parts of the perforation and the folding line increasing progressively with the distance from the middle part along this perforation, b) the inner top flap (22), joined to the top of the box, has, on its outer edge, opposite the folding line between the inner top flap and the main part, a first shape (40) adapted to the middle part of the perforation so as to slightly interfere with the pressing down of the part of the outer top flap defined by the middle part of the perforation during the opening of the box, and a second shape (42, 44) adapted to the two outer parts of the perforation so as to slightly interfere with the tearing off of the outer top flap during the opening of the box.

11. A box according to claim 10, for the production of a box, the length L of which is less than twice the width l of this box, in which at least one of the top lateral flaps and at least one of the bottom lateral flaps has a width which is less than the width of the box and characterised in that the corner of each of the two lateral top flaps opposite the inner top flap and the corresponding folding line connecting this flap to the corresponding lateral vertical wall of the box, is cut out in such a way as to free the area located opposite the middle part of the perforation when the box is closed in order not to interfere with the pressing down of the part of the outer top flap defined by the middle part of the perforation during the opening of the box.

12. A box according to claim 10, in which the middle part of the perforation is practically a semi-circle.

13. A box according to claim 10, in which the first shape is a semi-circular cutout.

14. A box according to claim 10, in which the second shape consists of two linear sloping parts connecting the first shape to the sides of the inner top flap which are adjacent to the lateral walls of the box so that the dimension of the inner top flap at the level of these sides is approximately equal to the distance separating the ends of the perforation of the side of the outer top flap opposite the folding line connecting the said outer top flap to the corresponding vertical wall of the box.

15. A box according to claim 10, for producing a corrugated cardboard box of the 2.4 BE type, characterised in that the perforation comprises a succession of cut sections alternating with uncut sections, the cut sections having a length which is double that of the uncut sections.

16. A box according to claim 15, in which the arcs of circles defining the outer parts of the perforation have a radius of less than 35 cm.

17. A box according to claim 15, in which the sections of the outer parts of the perforation located in the vicinity of the middle part are separated by a distance of about 6 cm.

18. A box according to claim 15, in which the perforation ends about 4 cm from the lateral walls of the box.

* * * * *